US005412166A

United States Patent [19]

Krupp et al.

[11] Patent Number: 5,412,166

[45] Date of Patent: May 2, 1995

[54] POWER WINDOW SWITCH CONTROL APPARATUS

[75] Inventors: Eric J. Krupp; Thomas P. Benzie, both of Canton, Mich.

[73] Assignee: United Technologies Automotive, Inc., Hartford, Conn.

[21] Appl. No.: 83,017

[22] Filed: Jun. 25, 1993

[51] Int. Cl.[6] ..... H01H 21/80

[52] U.S. Cl. ..... 200/6 R; 200/6 B

[58] Field of Search ..... 200/5 R, 6 R–6 C, 200/1 V, 468, 433; 337/9

[56] References Cited

U.S. PATENT DOCUMENTS

| | | | |
|---|---|---|---|
| 3,391,384 | 7/1968 | Hughes | 439/76 |
| 3,501,582 | 3/1970 | Heidler et al. | 174/52.2 |
| 3,551,874 | 12/1970 | Volinskie | 439/63 |
| 3,586,796 | 6/1971 | Simovits, Jr. et al. | 200/6 R |
| 3,805,206 | 4/1974 | Ege | 337/9 |
| 3,881,245 | 5/1975 | Dudley et al. | 29/840 |
| 3,947,956 | 4/1976 | Leroux et al. | 156/89 |
| 4,051,550 | 9/1977 | Seno et al. | 361/402 |
| 4,218,724 | 8/1980 | Kaufman | 361/736 |
| 4,304,640 | 12/1981 | Walker | 361/748 |
| 4,385,791 | 5/1983 | Lovrenich | 439/83 |
| 4,389,552 | 6/1983 | Sorenson | 200/433 |
| 4,542,260 | 9/1985 | Pearce | 174/52.2 |
| 4,682,271 | 7/1987 | Yamada | 361/777 |
| 4,683,352 | 7/1987 | Yano et al. | 200/6 R |
| 4,689,442 | 8/1987 | Ozaki | 174/266 |
| 4,689,450 | 8/1987 | Sawada | 200/6 R |
| 4,695,682 | 9/1987 | Winogrocki | 200/5 R |
| 4,780,580 | 10/1988 | Sawada | 200/1 VX |
| 4,811,168 | 3/1989 | Chesnut et al. | 361/752 |
| 4,822,962 | 4/1989 | MacCourt | 200/61.88 |
| 4,857,002 | 8/1989 | Jensen et al. | 439/76 |
| 4,871,885 | 10/1989 | Kamada | 200/5 R |
| 4,898,539 | 2/1990 | Glover et al. | 439/81 |
| 4,906,515 | 3/1990 | Inoguchi | 428/209 |
| 4,952,529 | 8/1990 | Grider | 437/209 |
| 5,270,506 | 12/1993 | Masoner | 200/468 |
| 5,293,507 | 3/1994 | Hayakawa | 200/6 B |

*Primary Examiner*—J. R. Scott

*Attorney, Agent, or Firm*—Harness, Dickey & Pierce

[57] ABSTRACT

A power switch control module for a power window control circuit of a motor vehicle. The control module incorporates a printed circuit board, a plurality of switch contacts secured to the printed circuit board, a plurality of connector terminals also secured to the printed circuit board, a plurality of high current traces formed on an upper surface of the printed circuit board for coupling selected pairs of the switch contacts and connector terminals electrically together, and a switch control. The switch control is mounted in a frame member for pivotal movement relative to the printed circuit board and is movable between up and down positions. When in the up position the switch control electrically couples a first selected pair of switch contacts and when in the down position the switch control electrically couples a second selected pair of the switch contacts. The high current traces are capable of handling about 20–80 amps of current. Since the high current traces are formed on the upper surface of the printed circuit board, no injection molding, tooling or techniques are required for construction of the module as typically required with prior art control modules. Also, the undersurface of the printed circuit board can advantageously be used to mount other electronic components of the control circuit.

2 Claims, 2 Drawing Sheets

POWER WINDOW SWITCH CONTROL APPARATUS

BACKGROUND OF THE INVENTION

1. Technical Field

This invention relates to electrical switching assemblies, and more particularly to a power control switching circuit for high current switching. The power control switching circuit is particularly well adapted for use with power window control circuits in motor vehicles which utilize power driven window assemblies.

2. Discussion

Power windows are now commonly offered in many motor vehicles such as automobiles and trucks. Such power windows usually incorporate at least one DC motor for driving the window up and down in response to an operator actuatable switch. The current required to drive such motors is usually fairly high, and most often well above that which would ordinarily be capable of being transmitted by printed circuit boards. As is well known, conventional printed circuit boards have traditionally been limited to low current applications where currents are kept generally below about 0.5 amps. The current typically required for driving motors associated with power window control circuits is generally ranges from about 20 to 80 amps.

Heretofore, the standard approach to automotive switch control design has involved insert molding technology. This involves using a plurality of independent brass or copper lead frames (i.e., conductors) to carry high electrical current between a vehicle wiring harness and the switch contacts of an operator accessible switch control. These lead frames are typically imbedded in a plastic body or substrate. This process generally requires specialized injection mold tooling and techniques which can accommodate variously shaped and sized lead frames. Frequently, "two shot" molding is required in which the plastic material above and below the portions of the lead frame is injected into the mold in sequential steps. Such apparatus and procedures are relatively expensive and time consuming and add to the complexity and cost of power window control circuits in view of the increased tooling expense required to produce such assemblies. Also, the plastic body portion described above is typically restricted to accommodating only the lead frames and associated switch contacts. Thus, a separate printed circuit board is typically needed for the electronic components of the control circuit. This also significantly increases the overall cost of the control circuit.

Accordingly, it is the principal object of the present invention to provide a power switching control module which can be used with a conventional printed circuit board to enable high current switching for use in power window control circuits and automotive vehicles.

It is still another object of the present invention to provide a power switching control module in which high current traces are employed on the surface of a printed circuit board in lieu of imbedding a portion of a lead frame within an independent plastic body piece, to thereby eliminate the need for injection molding tooling and techniques.

SUMMARY OF THE INVENTION

The above and other objects are accomplished by a power switching control module in accordance with preferred embodiments of the present invention.

In one preferred embodiment the module includes a printed circuit board, a plurality of switch contacts secured to the printed circuit board, a plurality of connector terminals secured to the printed circuit board, a plurality of high current traces formed on an outer surface of the printed circuit board for coupling selected ones of the switch contacts and connector terminals electrically together, and an operator actuatable switch control movable between an up and a down position which includes a pair of activating elements therein, where at least one of the activating elements causes a first conductive member to couple selected ones of the switch contacts together electrically when the switch control is in the up position, and where at least one of the activating elements causes a second conductive member to couple at least a second pair of switch contacts electrically together. In the preferred embodiment a frame member is also associated with the printed circuit board and pivotally mounts the switch control such that the switch control may be moved pivotally between the up and down positions.

In the preferred embodiments the high current traces are preferably formed from copper and are capable of carrying from between about 20 amps to 80 amps. The connector terminals are further connectable to a wiring harness of a vehicle having a conventional terminal connector. Thus, current can be transmitted between the vehicle wiring harness and the connector terminals and controlled by the switch control.

BRIEF DESCRIPTION OF THE DRAWINGS

The various advantages of the present invention will become apparent to one skilled in the art by reading the following specification and subjoined claims and by referencing the following drawings in which:

DETAILED DESCRIPTION OF THE PREFERRED EMBODIMENT

Figure 1:
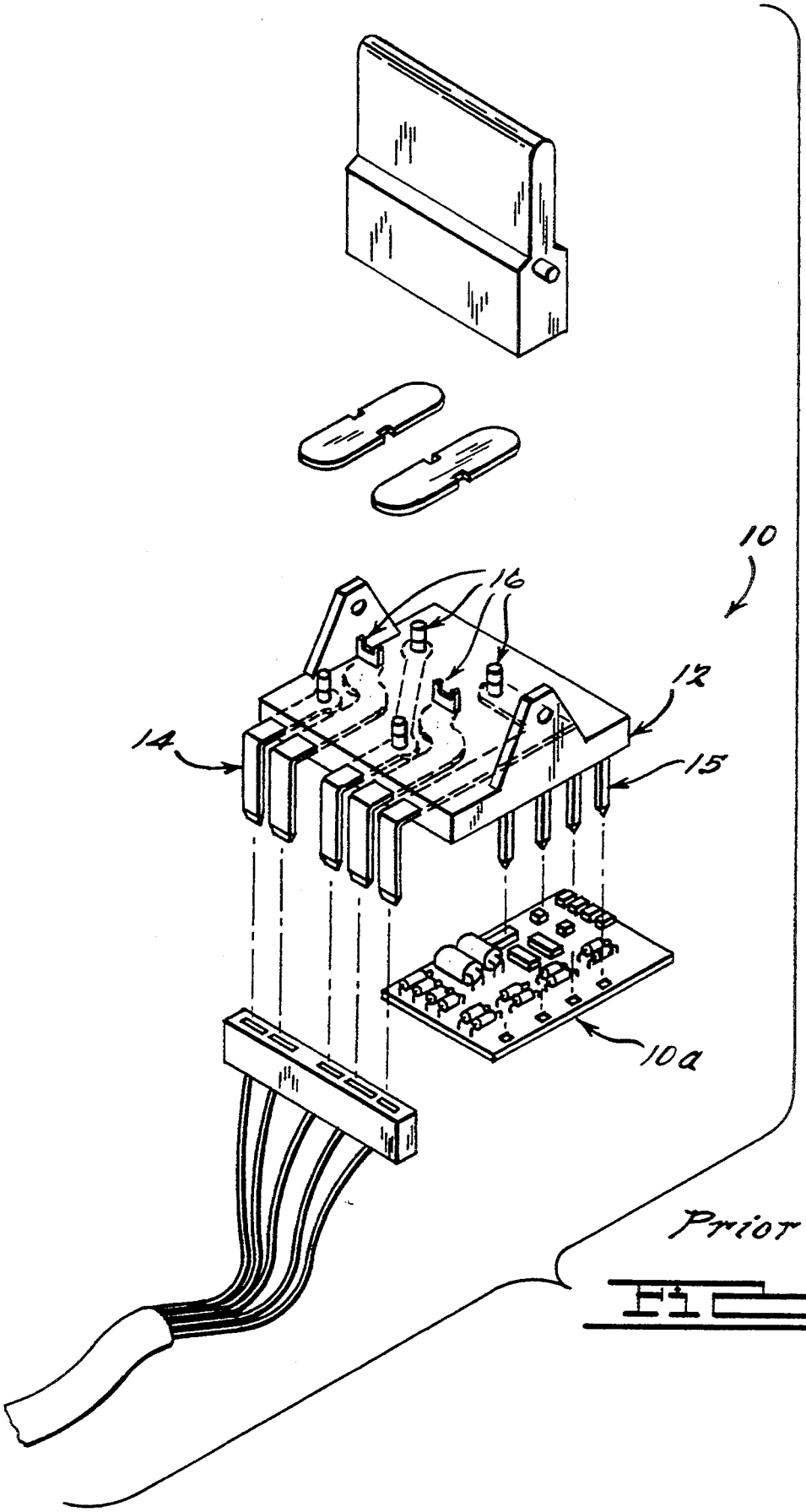
Prior Art FIG. 1.
FIG. 1 is an illustration of a typical prior art switching control assembly incorporating a plurality of lead frames imbedded in a plastic component via injection molding techniques.

Referring to FIG. 1, there is shown a typical prior art switching control module 10. The switching control module 10 incorporates a plastic body portion 12 within which are imbedded portions of a plurality of lead frames 14 and portions of a plurality of switch contacts 16. A plurality of additional lead frames 15 may also be included for supporting a separate printed circuit board 10a. The module 10 is constructed with injection molding tooling and techniques. This involves placing portions of the lead frames and portions of the switch contacts within the mold before injecting the material which will form the plastic body portion 12. Since lead frames having a variety of shapes and sizes are often required in producing switching control modules for a variety of vehicles, changes in injection molding tooling can add significantly to the expense of producing the switching control module 10. Even without tooling changes, the equipment required to injection mold the plastic body portion 12 and the steps required to perform injection molding still represent a significant added expense in producing the module 10. Still further, a separate printed circuit board is required to hold the electronic components of the control circuit with which the module 10 is used. This further increases the overall cost of the control circuit.

Figure 2:
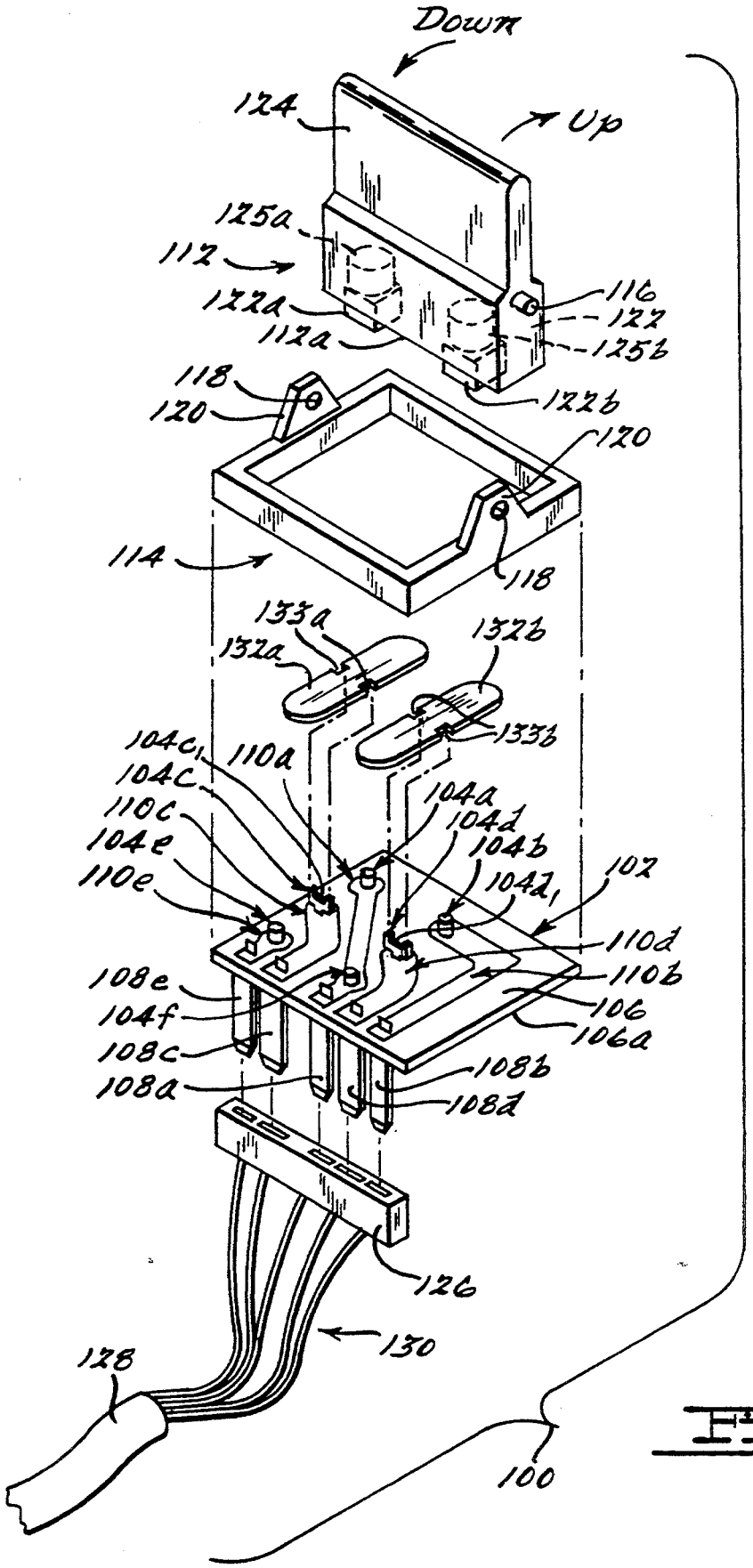
FIG. 2 is an exploded perspective view of a power switching control module in accordance with a preferred embodiment of the present invention showing the high current traces formed on an outer surface of the printed circuit board thereof.

Referring now to FIG. 2, there is shown a power switching control module 100 in accordance with a preferred embodiment of the present invention. The module 100 generally comprises a printed circuit board 102, a plurality of switch contacts 104*a*–104*f* secured to an upper surface 106 of the printed circuit board 102, a plurality of connector terminals 108*a*–108*e* secured to the printed circuit board 102, a plurality of high current traces 110*a*–110*e* formed on the upper surface 106 of the printed circuit board 102, and a switch control 112. In the preferred embodiment the switch control 112 is pivotally coupled to a frame member 114 via a plurality of shoulder portions 116 which are mountable within a pair of apertures 118 in arm portions 120 of the frame member 114.

The switch control 112 is known in the art and generally includes at least a pair of switch activating elements 122*a* and 122*b* therein which are partially housed within a recess in a lower portion 112*a*. Each of the elements 122*a* and 122*b* are biased outwardly of the lower portion 112*a* by a pair of springs 125*a* and 125*b*. The switch control 112, when secured to the frame member 114, is movable pivotally between an up position and a down position. This is accomplished by the operator either pulling up or pushing down on a portion 124 of the switch control 112 with the fingers of a hand. The frame member 114 is further adapted to be secured in any conventional fashion to the printed circuit board 106 such that the activating elements 122*a*, 122*b* of the switch control 112 are positioned over the switch contacts 104*a*–104*f*. The frame member 114 is also preferably constructed from plastic such as by molding.

With further reference to FIG. 2, the connector terminals 108 are adapted to be coupled to a terminal connector 126 of a vehicle wiring harness 128. The terminal connector 126 includes contacts therein, in conventional fashion, which couple a plurality of conductors 130 of the wiring harness 128 to corresponding ones of the connector terminals 108 when the terminal connector 126 is physically inserted over the connector terminals 108.

In the preferred embodiment, the power switching control module 100 incorporates a pair of conductive elements 132*a* and 132*b* which each include a pair of notched portions 133*a* and 133*b*, respectively. The conductive elements 132*a* and 132*b* each are adapted to be placed over the switch contacts 104*c* and 104*d* on the printed circuit board 102. It will be noted that switch contacts 104*c* and 104*d* include a recess $104c_1$ and a recess $104d_1$. Conductive element 132*a* sits on the switch contact 104*c* such that the notched portions 133*a* rest in the recess $104c_1$ and the notches 133*b* of the conductive elements 132*b* rest within the recess $104d_1$. In this manner, conductive element 132*a* "rocks" into contact with one or the other of the switch contacts 104*a* or 104*e*. Similarly, the conductive element 132*b* rests on the switch contact 104*d* and rocks into contact with either the switch contact 104*f* or 104*b*. The switch contacts 104*c* and 104*d* are further positioned such that they sit on opposite sides of a center-line extending between the shoulder portion 116.

In operation, when the switch control 112 is not engaged (i.e., in a "neutral" position) the conductive element 132*a* is biased by its associated spring 125*a* and activating element 122*a* into contact with, for example, switch contact 104*a*. Thus, a complete current path exists between contacts 104*c*, 104*a*, connector terminal 108*c* and terminal 108*a*. The other conductive element 132*b* is biased, for example, into contact with switch contact 104*f*. Thus, a complete current path is formed between contacts 104*f* and 104*d*, and terminals 108*a* and 108*d*. When an operator pushes the portion 124 of the switch control 112 upwardly, the activating element 122*a* "rocks" the conductive element 132*a* so that it electrically connects switch contacts 104*c* and 104*e*, thus forming a first circuit. When the switch control is pushed downwardly from its center (i.e., neutral) position by the operator, it moves pivotally relative to the printed circuit board 102 and the activating element 122*b* urges the conductive element 132 to "rock" into electrical contact with the switch contact 104*d*. When switch contacts 104*b* and 104*d* are electrically coupled together, a current path is formed between connector terminals 108*d* and 108*b*, thus forming a second circuit. Current flowing in the circuit paths formed in the up and down positions of the switch control 112 may thus be used to control a reversible DC motor of a power window control circuit such that the motor causes a window to be raised while the switch control 112 is held by the operator in the position, or lowered when the switch control 112 is held in the down position.

The high current traces 110*a*–110*d* each are formed preferably of copper deposited on the upper surfaces 106 of the printed circuit board 102 and are each adapted to carry about 20–80 amps of current. Other suitable conductive material could also be used in lieu of copper. Most importantly, however, the use of the high current traces 110*a*–110*d* allows the power control module 100 to be constructed in accordance with more conventional printed circuit board construction techniques and without the need for any injection molding tooling or techniques to be applied in constructing the module 100. Furthermore, the electronic components of the control circuit can be mounted on the opposite side 106*a* of the printed circuit board if so desired. This can help to significantly reduce the overall cost of the control circuit within which the module 100 is used.

The power control module 100 thus provides a relatively inexpensively constructed power switching module for controlling the high current switching needed to operate a power window control circuit. While the invention 100 has been described in connection with a power window control circuit for a vehicle, it will be readily appreciated that the power switching control module 100 could readily be employed in a wide variety of other high current switching circuits to significantly reduce the cost of such circuits. For example, the switching control apparatus described herein could readily be adapted for use, with little or no modification to control the power seat(s) of a vehicle, a power rear view mirror, vehicle lighting, vehicle heating and cooling circuits, or a rear window defroster. It will also be appreciated that the apparatus 100 of the present invention is readily adaptable to a wide variety of applications other than those in connection with motor vehicles.

Those skilled in the art can now appreciate from the foregoing description that the broad teachings of the present invention can be implemented in a variety of forms. Therefore, while this invention has been described in connection with particular examples thereof, the true scope of the invention should not be so limited since other modifications will become apparent to the skilled practitioner upon a study of the drawings, specification and following claims.

What is claimed is:

1. A power window switch control apparatus for switching current in the range of about 20 amps to 80 amps to elevationally control placement of a vehicle window, said apparatus comprising:

a printed circuit board having an outer surface;

a plurality of switch contacts secured to said printed circuit board;

a plurality of connector terminals secured to said printed circuit board;

a plurality of high current carrying copper traces formed on said upper surface of said printed circuit board, each of said copper traces coupling a selected one of said switch contacts and a selected one of said connector terminals electrically together;

a frame secured to said printed circuit board, said frame having a pair of outwardly protruding arm portions each having an aperture therethrough;

a first conductive element and a second conductive element, each of said first and second conductive elements being supported by a corresponding switch contact for rocking movement at approximately a center point of a length thereof; and a switch control having a plurality of shoulder portions engageable with said apertures of said arm portions of said frame such that said switch control is movable pivotally by an operator between an up position and a down position said switch control being positioned so as to be centered with each said conductive element and including a plurality of activating elements, at least one of said activating elements being disposed so as to be approximately centered over said first conductive element when said switch control is not engaged by an operator of said vehicle, said switch control causing a rocking of said first conductive element such that a first selected pair of said switch contacts is electrically coupled together via said first conductive element when said switch control is in said up position and causing a rocking of said second conductive element such that a selected second pair of said switch contacts is electrically coupled together via said second conductive element when said switch control is moved pivotally into said down position.

2. The apparatus of claim 1, further comprising:

a vehicle wiring harness having a plurality of conductors; and an electrical connector electrically coupled to said plurality of conductors for electrically coupling said plurality of conductors to said connector terminals, said electrical connector operating to transmit electrical current between said connector terminals and said electrical connector.

* * * * *

UNITED STATES PATENT AND TRADEMARK OFFICE

CERTIFICATE OF CORRECTION

PATENT NO. : 5,412,166
DATED : May 2, 1995
INVENTOR(S) : Eric J. Krupp, et. al.

It is certified that error appears in the above-identified patent and that said Letters Patent is hereby corrected as shown below:

Title page, item [73], Assignee: should read--United Technologies Automotive, Inc., 5200 Auto Club Drive, Dearborn, Michigan 48126--.

Signed and Sealed this

Sixteenth Day of April, 1996

Bruce Lehman

*Attest:*

BRUCE LEHMAN

*Attesting Officer*

*Commissioner of Patents and Trademarks*